United States Patent [19]

Mullen

[11] Patent Number: 4,750,303

[45] Date of Patent: Jun. 14, 1988

[54] SILO EXPLOSION DOOR

[76] Inventor: Terrance J. Mullen, 4714 Laurel St., Bellaire, Tex. 77401

[21] Appl. No.: 813,507

[22] Filed: Dec. 26, 1985

[51] Int. Cl.[4] ..... E04B 1/92

[52] U.S. Cl. ..... 52/98; 52/1

[58] Field of Search ..... 52/1, 98, 99, 232, 195, 52/196, 397, 395; 49/141, 127.6, 127.8, 127.12, 98; 29/235

[56] References Cited

U.S. PATENT DOCUMENTS

| | | | |
|---|---|---|---|
| 2,761,536 | 9/1956 | Bradley | 52/232 |
| 3,112,535 | 12/1953 | Kinney | 52/1 |
| 3,258,890 | 7/1966 | Dirske | 52/397 |
| 4,308,695 | 1/1982 | Ehrsam | 52/1 |
| 4,656,793 | 4/1987 | Fons | 52/1 |

FOREIGN PATENT DOCUMENTS

| | | | |
|---|---|---|---|
| 509082 | 1/1955 | Canada | 52/397 |
| 67550 | 12/1940 | Czechoslovakia | 52/127.8 |
| 1324718 | 3/1963 | France | 52/397 |

*Primary Examiner*—John E. Murtagh
*Attorney, Agent, or Firm*—George R. Royer

[57] ABSTRACT

The subject invention is silo explosion door serving as a safety protection apparatus to prevent damage resulting from an explosion within a silo from internally generated gaseous pressures. The invention is structured as an automatically actuated door mechanism that opens solely by the internal pressure generated against the inside areas of the door, and in this inventive application the door is equipped with an elastomeric frame that encompasses the perimeter of the door. This elastomeric frame is engineered and designed to have a specified internal resistance, as governed by its shape and modules of elasticity, which when exceeded by the internal pressure within the silo permits the door to be forced and ejected outwardly away from the silo, thereby permitting the escape of internal pressure.

1 Claim, 1 Drawing Sheet

SILO EXPLOSION DOOR

BACKGROUND OF INVENTION

The invention herein relates to safety devices utilized in the storage of bulk materials that comprise finely divided or comminuted materials. The device is more specifically addressed to those types of safety devices that are automatically deployed to relieve internal pressures whenever the internal gaseous pressure inside the storage bin exceeds a predetermined level of safety presenting an explosion potential.

As is well known, the storage of bulk materials in the form of finely-ground materials, having a dust-like or finely particularized composition, possesses obvious dangers, when confined in an enclosed container. Grains are particularly susceptible to this problem when stored in bulk comminuted form. Internal gaseous pressures will build up from various biological processes within the grain as it is stored. These gases inevitably increase in volume and pressure inside a closed storage container and whenever the pressures become too intense, an explosion may occur, unless such internal pressures are relieved sufficiently. The resultant damage to the container and the loss of stored material is often substantially exceeded by the loss of surrounding property and life.

As a consequence of the foregoing, there have been many devices in the prior art structured as safety devices to overcome the foregoing problem by providing safety values or escape valves to relieve excess pressure. Such pressure escape valves used to relieve excess pressure for contained gases is not new in the art. Moreover, safety explosion doors, which automatically blow out whenever a certain pressure level is exceeded, are not new in the art. However, such safety doors have been structured mainly in the form of a frangible door mounted in a metal frame. The frame and door are usually mounted to the silo wall. Such devices have not been completely effective for safety purposes. Many of the problems encountered with the use of existing safety devices have been seen in their limited efficacy and effectiveness. One of the greatest difficulties with existing safety devices have been seen in the automatic triggering mechanism to actuate the particular safety apparatus. In many instances, such safety devices do not function effectively in that the automatic sensing mechanism does not always operate properly, with the result that there is no available escape for expanding gases, etc. Additionally, many such devices are too complicated or complex and do not operate satisfactorily because of the maintenance and upkeep of said items.

Devices that are relatively simplistic usually require less maintenance and are more effective under long term conditions. This invention is conceived to that end such that it provides simplicity and effectiveness simultaneously, and provides a unique concept of utilizing the inherent or stored energy in the elastomeric frame as a triggering and dynamic member to eject the door upon response to a given internal pressure level in the storage container. The following objects of the subject invention are directed accordingly.

OBJECTS

It is an object of the subject invention to provide an improved safety device for bulk storage bins;

It is also an object of the subject invention to provide an improved safety release mechanism for use in storage of grain or other similar materials;

Another object of the subject invention is to provide a safety door, which opens upon proper pressure sensing with its own stored energy, without the aid of auxiliary machines or energy;

Yet another object of the subject invention is to provide an improved safety escape apparatus to prevent explosion in silos containing quantities of finely comminuted particles;

A further object of the subject invention is to provide a safety door that is automatically ejectable without the aid of extrinsic machinery;

Another object of the subject invention is to provide an improved storage system for bulk materials;

Another object of the subject invention is to provide an improved safety door for storage silos;

Other and further objects of the subject invention will become apparent from a reading of the folowing description and others in conjunction with the drawings.

DRAWINGS

GENERAL EMBODIMENT

The subject invention is a silo explosion door adapted to be fitted or retrofitted to exterior wall of a storage silo used to store bulk substances, particularly those substances comprised of fine, dust-like particles that develop gaseous substances from various processes. In general, the subject invention comprises a frame for an explosive door wherein the frame is comprised of an elastomeric material that extends around the complete perimeter of the door. Such an explosion door has as its primary function that of automatically ejecting outwardly in the event internal pressures in the silo exceed a given level which are considered dangerous and bordering upon explosive capabilities.

In the general embodiment, the silo explosion door frame is comprised of an elastomeric material the resistance of which is of such a value that whenever the internal pressure from gases inside the silo are exceeded, the elastomeric frame utilizes its own shape and modulus of elasticity as a stored force which when exceeded forces the door open to be ejected outwardly to release pressures inside the container.

DESCRIPTION OF PREFERRED EMBODIMENT

In describing the preferred embodiment of the subject invention, the following terminology will be utilized. The word "upper" will refer to those areas of the storage member that are oriented up away from the ground. The word "lower" will be used in opposite fashion. The words "longitudinal central axis" will refer to that axis that extends longitudinally and symmetrically through the longest extend of the member. Moreover, in describing the preferred embodiment of the subject invention, it is to be stressed that the following description will be of only one specific embodiment, and it will be understood that this specific descripton will not in any manner limit the scope of the overall invention as set forth in the claims annexed herein, as the invention is conceived for broader applications.

Figure 1:
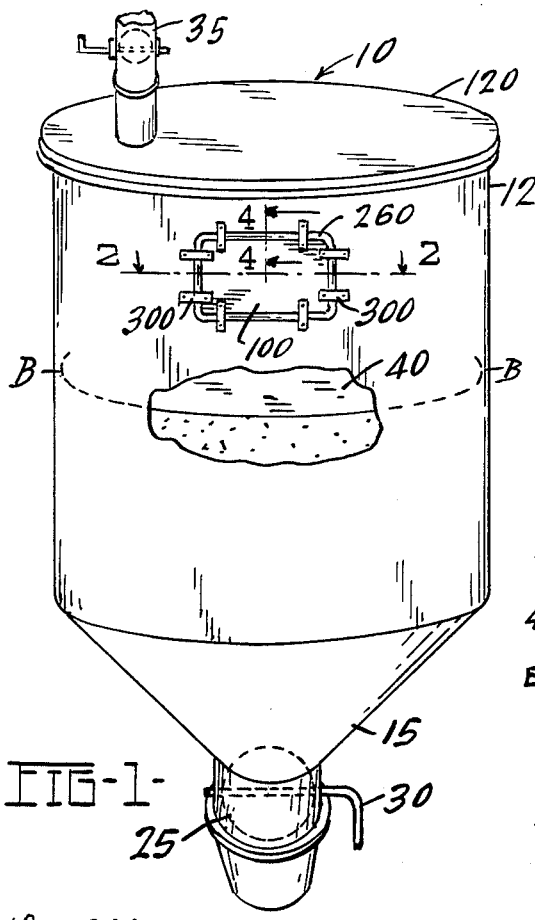
FIG. 1 is a perspective view of a typical silo storage bin, showing the location of the silo explosion door.

Referring now to the drawings in which a preferred embodiment of the subject invention is shown, and initially to FIG. 1, a vertically disposed silo of generally cylindrical configuration is shown, comprising upper cylinderical member 12. Silo 10 has a lower integrally annexed inveted conical section 15, the lower narrow neck portion 20 of which leads to output opening 25 controlled by value-like member 30 so as to control the downward output flow from a complete cutoff position to variable opening positions. An input feed member 35 on the top of the silo functions to fill the silo 10, as necessary. The foregoing cylindrical-conical shape for storage silo 10 is only exemplary, as the subject invention is equally applicable to silos or storage bins of any configuration or alternate structure.

Attention is again addressed to FIG. 1 and particularly to the upper cylindrical portion 12 of the silo 10. In particular, as shown in the cutaway view of FIG. 1 and as shown in phantom by load level line BB, the silo 10 is generally only filled to a level up to, but not exceeding said load level line B-B. Any gases formed from the stored materials below load level line B-B generally collect above such load level line, and thus the internal spatial area 40 above such load level line BB may be considered the gaseous collection zone. Above load level line B-B, and generally juxtaposed adjacent the spatial area 40 is an explosion door 100, which is typically a rectangular member, although this configuration may vary from structure to structure, as the design of particular storage silo permits. The explosion door 100 is emplaced in silo 10 at a position approximately one-half the distance between fill level line B-B and the ceiling 120 of the storage silo 10. This specific positioning is optional however. As shown, the explosion door 100 is affixed over the outer periphery of the silo 10, as shown in FIG. 1.

Figure 2:
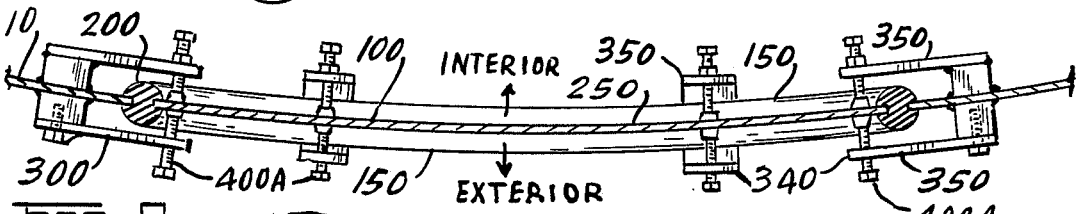
FIG. 2 is a top elevational view of the silo explosion door member.

As seen in FIG. 1, the storage silo door 100 is rectangular when viewed in frontal elevation from the outside of the silo. Since the silo 10 is cylindrical at the place where the door is affixed, door 10 is curved, as seen in the top elevational view of FIG. 2, so as to fit conformingly along the exterior wall of silo 10. Thus, as seen in FIG. 2, the exterior surface 150 of the door 100 is slightly convex while the interior surface 160 of the door is slightly concave.

Figure 3:
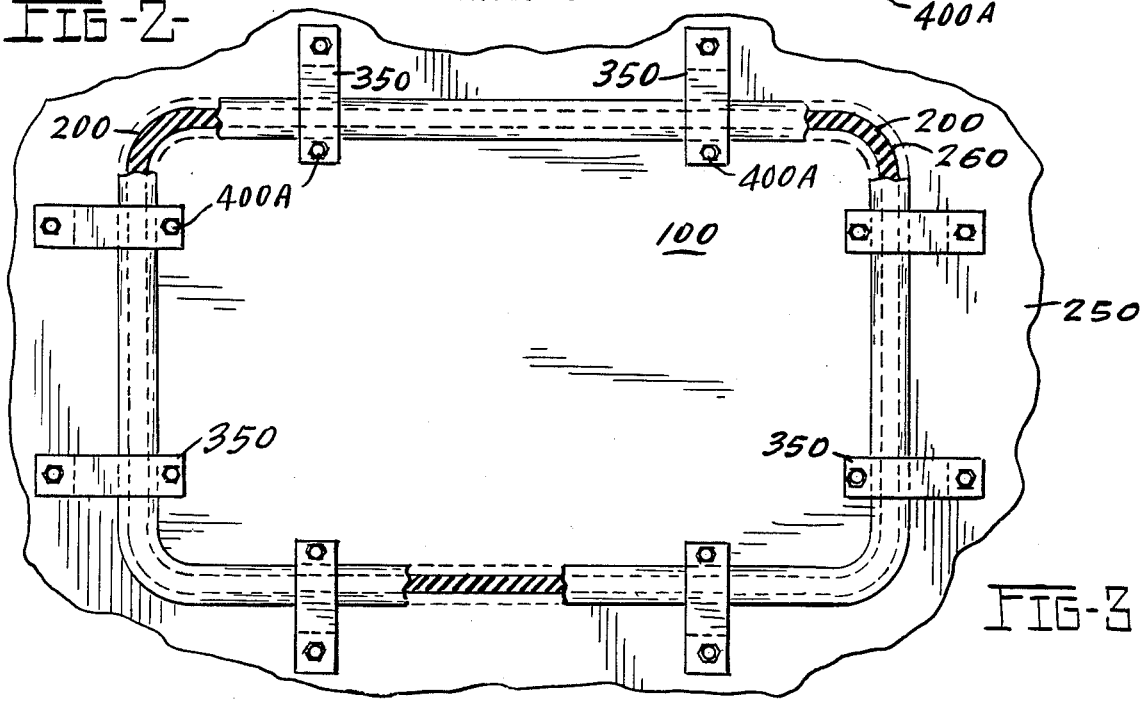
FIG. 3 is a front elevational view of the silo explosion door showing the constructional disposition of the elastomeric frame around the door perimeter.

Referring now to FIG. 3, as can be seen in the frontal elevational view hereof, the explosion door 100 is bordered by elastomeric frame 200, also of generally rectangular configuration. The corners of frame 200 are joined in a unitary manner.

Figure 4:
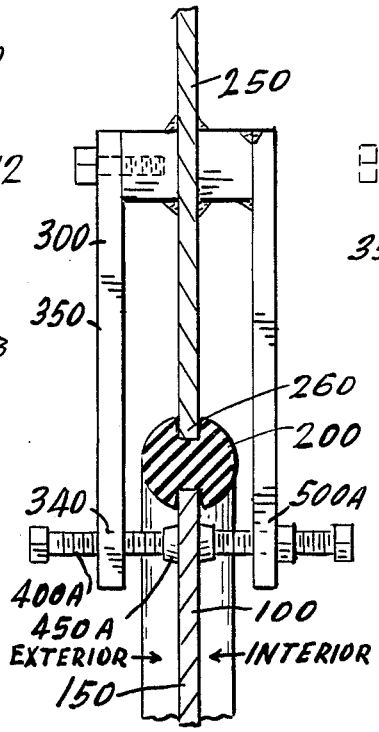
FIG. 4 is a top elevational view, in part, of the locking and release mechanism of the subject device.
Figure 5:
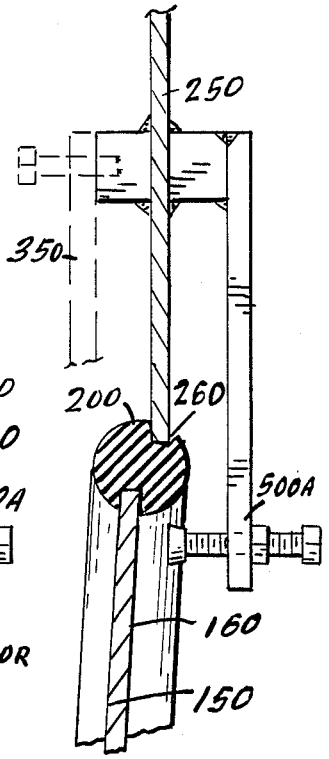
FIG. 5 is the same top elevational view of FIG. 4 showing the action of the subject mechanism upon explosion of the door, as generated initially by internal pressure.

As can be seen in the drawings, particularly FIGS. 2, 4 and 5, the door 100 is affixed to the silo wall 250 as follows. The elastomeric frame 200 is integrally affixed inside the rectangular door opening 260, in the position shown in FIGS. 2 and 3. The door 100 is then forced inside the frame 200 with the aid of installation tool 300 which is threaded tool member 340 inserted and mounted perpendicularly through a rectangular bar member 350, which is in turn mounted parallel to the wall 120 of the silo bin 100. More specifically, the door mounting member comprises bar members 350A and 350B mounted on each side of door opening 260, which bar members extend only a minimal distance beyond the door side towards the center of door opening .

As seen in the drawings the end of each treaded bolt 400A, 400B, 400C carries a bell shaped member, with a flattened end 450A which is adapted to impinge, in a flush manner against the outer surface of the door member 120 during the door installation process. As can be seen, as each bolt member is tightened inwardly, the respective bell shaped ends push the outer perimeter of door 120 into place inside the elastomeric frame as graphically shown in FIG. 4. Additionally, as seen in FIGS. 2 and 4, inner door stops 500A, 500F are constructed to prevent the door from moving inwardly beyond the door frame 100, as shown. These door stops are essentially similar in constructional arrangement to the door installation members, but are in mirror image relationship.

As can be seen from the drawings the safety door is structured to be installed in the opening in the storage silo such that said safety door fits conformingly over said opening and the perimeter edges thereof in a congruent manner, thereby covering the entire opening in a congruent manner. The elastomeric frame member for said door is adapted to fit around and on the perimeter edges of said opening in said silo. The elatomeric frame is constructed and installed around and on said perimeter edges with inherent elastomeric energy by tensioning and drawing it over said perimeter edges of said opening in a taut manner so as to resiliently store energy therein as it is stored. This inherent tension enables the frame to eject out forcibly and dynamically when sufficient pressue within the silo overruns this resiliently stored energy. This serves to eject the door simultaneously.

I claim:

1. A safety door for a storage silo of generally cylindrically configuration, wherein said silo has an opening having perimeter edges extending form the inside to the outside of said storage silo, wherein said safety door is adapted to be installed and juxtaposed congruently over said opening in said silo and said safety door being explodable outwardly upon a predetermined pressure level inside said silo, said safety door comprising the following elements:

(a) an elastomeric frame member affixed conformingly and continuously around the perimeter of said silo opening, and wherein said elastomeric frame member is constructed and installed with inherent elastomeric energy by tensioning and drawing said elastomeric frame onto the perimeter edges of said opening in said silo;

(b) a door member conformingly mounted with elastomeric tension inside said frame member, said door having an inner face and outer face, with said door being held in such conforming position solely by said tensioned elastomeric frame member;

(c) a plurality of first tensioning means in the form of removable and braced threaded members that are longitudinally adjustable and movable in a direction towards and impinging upon the outer face of said door member, to bias said door inwardly towards said frame member;

(d) Second tensioning means in the form of braced threaded members that are longitudinally adjustable and movable in a direction toward and impinging upon the inner face of said door member to bias said door outwardly away from said silo member.

* * * * *